US009689539B2

(12) United States Patent
Lin et al.

(10) Patent No.: US 9,689,539 B2
(45) Date of Patent: Jun. 27, 2017

(54) LED FLUORESCENT LAMP

(71) Applicants: Lap Wah Lin, Shenzhen (CN); Sek Lun Stephen Chan, Shenzhen (CN)

(72) Inventors: Lap Wah Lin, Shenzhen (CN); Sek Lun Stephen Chan, Shenzhen (CN)

( * ) Notice: Subject to any disclaimer, the term of this patent is extended or adjusted under 35 U.S.C. 154(b) by 256 days.

(21) Appl. No.: 14/689,252

(22) Filed: Apr. 17, 2015

(65) Prior Publication Data

US 2016/0305616 A1 Oct. 20, 2016

(51) Int. Cl.

| | |
|---|---|
| ***F21V 21/03*** | (2006.01) |
| ***F21S 8/00*** | (2006.01) |
| ***F21V 3/04*** | (2006.01) |
| ***F21V 17/02*** | (2006.01) |
| ***F21V 29/70*** | (2015.01) |
| *F21V 23/02* | (2006.01) |
| *F21Y 115/10* | (2016.01) |

(52) U.S. Cl.

CPC ..... *F21S 8/00* (2013.01); *F21V 3/049* (2013.01); *F21V 17/02* (2013.01); *F21V 29/70* (2015.01); *F21V 23/02* (2013.01); *F21Y 2115/10* (2016.08)

(58) Field of Classification Search

CPC ..... F21S 8/04; F21V 7/0025; F21V 17/02; F21V 21/02; F21V 21/03; F21V 29/70; F21V 3/0427

USPC ..... 632/217.08, 217.12, 217.13, 217.16, 632/217.17, 222, 249.02

See application file for complete search history.

(56) References Cited

U.S. PATENT DOCUMENTS

2010/0157610 A1* 6/2010 Xiao ..... F21V 15/013 362/370

2012/0051050 A1* 3/2012 Lee ..... F21S 2/005 362/235

* cited by examiner

*Primary Examiner* — Andrew Coughlin
*Assistant Examiner* — Keith Delahoussaye

(57) ABSTRACT

The invention discloses an LED fluorescent lamp, comprising a base plate, an end cap, an aluminum profile, a light diffusing plate, a light guide plate component, a lamp shade, a power unit and a lamp panel component as well as an LED lamp bead on the lamp panel component; first slots are arranged on two left side walls of the aluminum profile; the light guide plate can rotationally sleeved in the first slots; the top of the lamp shade is provided with a holding groove, at the bottom of which a hollowed-out part is hollowed out; the light diffusing plate is fixed in the holding groove and provided with many stripes on the surface; the stripes are crossed to form diamond-shaped stripes; and two sides of the lamp shade are arcs. The invention has the advantages of high thermal radiation effect, soft light and better light-emitting angle.

10 Claims, 9 Drawing Sheets

LED FLUORESCENT LAMP

TECHNICAL FIELD

The invention relates to lighting equipment, in particular to an LED fluorescent lamp.

DESCRIPTION OF THE RELATED ART

An LED (Light Emitting Diode) is a solid semiconductor device capable of converting electric energy into visible light or directly converting electricity into light. The core of the LED is a semiconductor chip; one end of the chip is adhered on a bracket and is a negative electrode, and the other end is connected with the positive electrode of a power unit, so that the whole chip is encapsulated by epoxy resin. The LED lamp has the advantages of less energy consumption and good radial brightness, gradually replacing traditional incandescent lamps.

The LED lamp in the prior art generally comprises a lamp holder, a radiator, a lamp panel, a lamp shade, and an LED lamp bead; the lamp holder, the radiator, and the lamp shade form a holding space; the lamp panel is fixed and closely joined to the radiator; the LED bead is installed on the lamp panel; while working, the light emitted by the LED lamp bead directly shoots out of the lamp shade to provide the illumination effect; the radiator is in thermal contact with the lamp panel and is capable of diffusing the heat generated by the LED lamp bead while working so as to guarantee the normal working of the LED lamp bead. The above LED lamp is only applicable to be used in an environment with lower illumination intensity requirements; the light emitted by the LED lamp bead directly shoots out of the lamp shade, has a great influence on the eyes, and it is unfavorable for operating personnel to work under the lamp. In addition, the above LED lamp is provided with screw holes on the lamp holder; the base is fixed to a ceiling through screws; the whole fixing base needs to be taken down during maintenance, and the installation and the maintenance are inconvenient. Therefore, it is necessary to further improve the above LED lamp.

BRIEF SUMMARY OF THE INVENTION

A technical problem to be solved by the invention is to provide an LED fluorescent lamp with high thermal radiation effect, soft light, and a large light-emitting angle.

To solve the above technical problem, the technical scheme utilized by the invention is to provide an LED fluorescent lamp, comprising a base plate, an end cap, an aluminum profile, a light diffusing plate, a light guide plate component, a lamp shade, a power unit and a lamp panel component, as well as an LED lamp bead arranged on the lamp panel component; the cross section of the aluminum profile is n-shaped; the lamp shade is installed on the top of the aluminum profile to form an enclosed space; the base plate is located at the bottom of the aluminum profile and is enclosed with the aluminum profile to form a holding cavity; the power unit is located in the holding cavity; and the end cap covers the base plate, the aluminum profile, and the end of the base plate.

The first slots are arranged on the two left side walls of the aluminum profile; the light guide plate component comprises two light guide plates which are provided with a circular guide pillar at one side and rotationally clamped in the first slots; the upper surfaces of the light guide plates are flat and are provided with light reflecting layers, and the lower surfaces thereof are wavy surfaces.

The top of the lamp shade is provided with a holding groove, at the bottom of which a hollowed-out part is hollowed out; the light diffusing plate is fixed in the holding groove and the surface of the light diffusing plate is provided with a plurality of stripes, which are crossed to form diamond-shaped stripes; and two sides of the lamp shade are circular arcs.

The beneficial effects of the invention are as follows: the LED lamp in the prior art has the disadvantages of small light-emitting angle, lower thermal radiation efficiency and blinding light, which directly shines into eyes and easily damages the eyes; this invention provides an LED fluorescent lamp; a first lamp panel and a second lamp panel are arranged on the aluminum profile in an oblique manner; the first lamp panel and the second lamp panel can make the light-emitting angle of the whole LED fluorescent lamp more than 180 degrees; the lamp shade is provided with a light diffusing plate, on which many crossed stripes are arranged to form diamond-shaped stripes; the light emitted by the LED lamp bead is reflected or refracted by the diamond-shaped stripes, so that shining light directly into people's eyes is avoided; meanwhile, the left side and the right side of the aluminum profile are provided with light guide plates; the upper surfaces of the light guide plates are coated with light reflecting layers capable of reflecting the incident light and increasing the illumination intensity of the LED fluorescent lamp; moreover, the light guide plates are rationally fixed on the aluminum profile to adjust the light-emitting angle of the LED lamp bead; the lower surfaces of the light guide plates are provided with wavy surfaces for increasing thermal radiation area; and the light guide plates combine with the aluminum profile to obtain a better thermal radiation effect.

DESCRIPTION OF MARK NUMBERS

Figure 1:
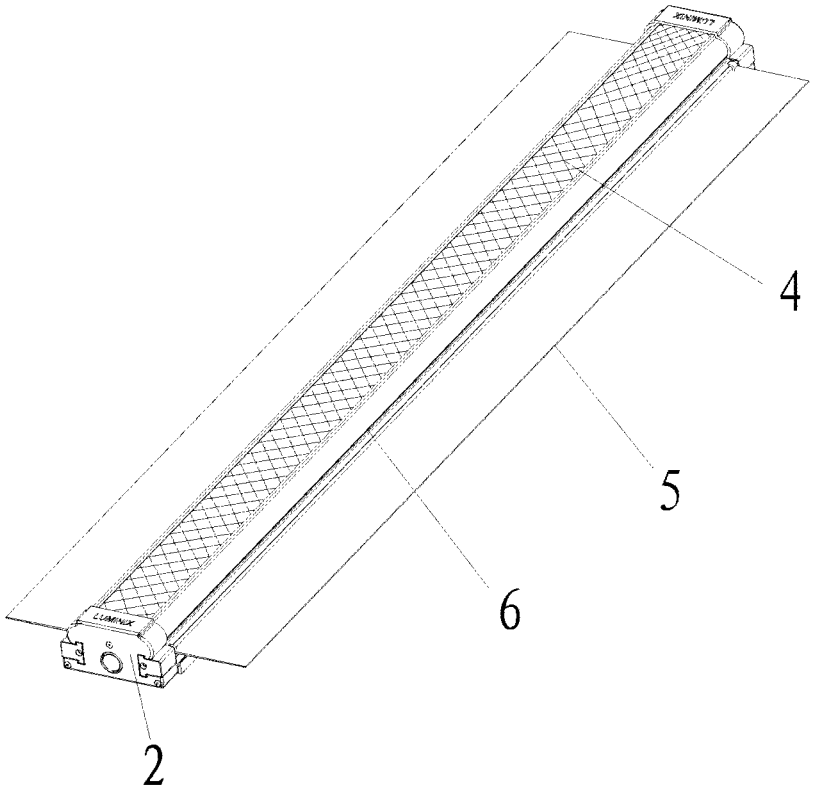
FIG. 1 is the whole structure diagram of the LED fluorescent lamp of the invention.
Figure 2:
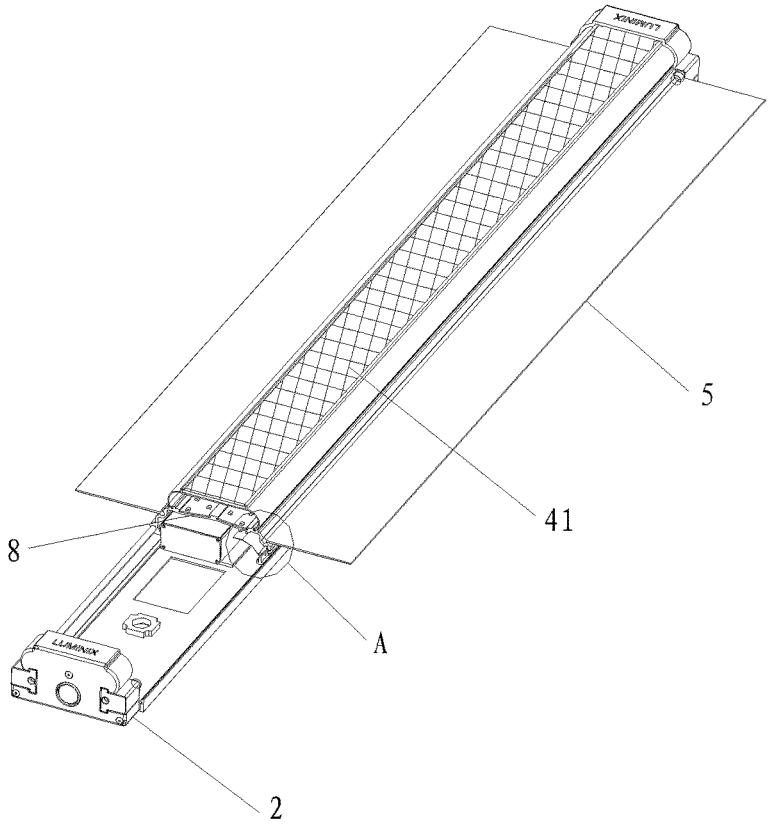
FIG. 2 is the internal structure diagram of the LED fluorescent lamp of the invention.
Figure 3:
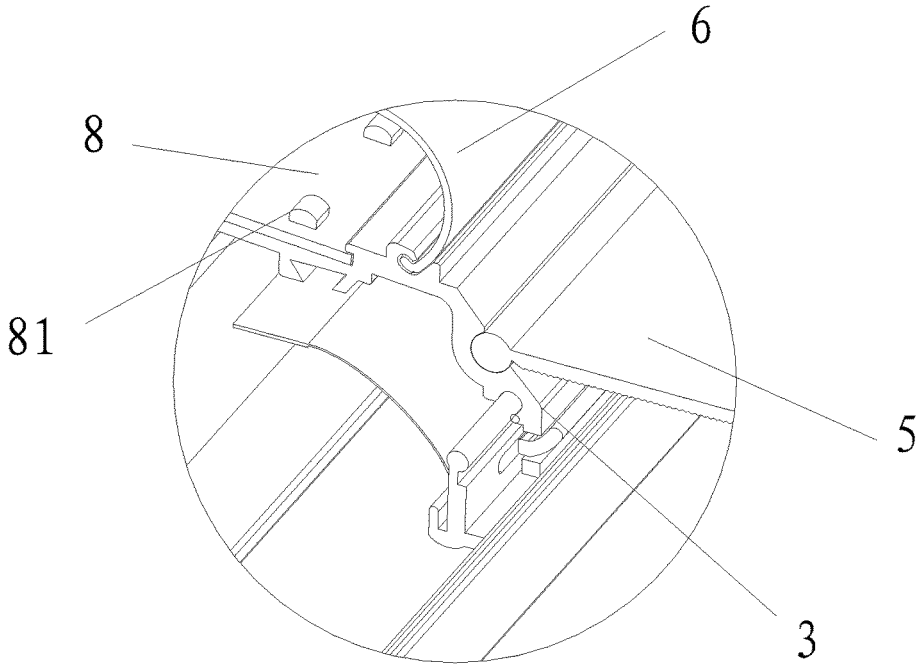
FIG. 3 is the amplified diagram of the part A in FIG. 2.
Figure 4:
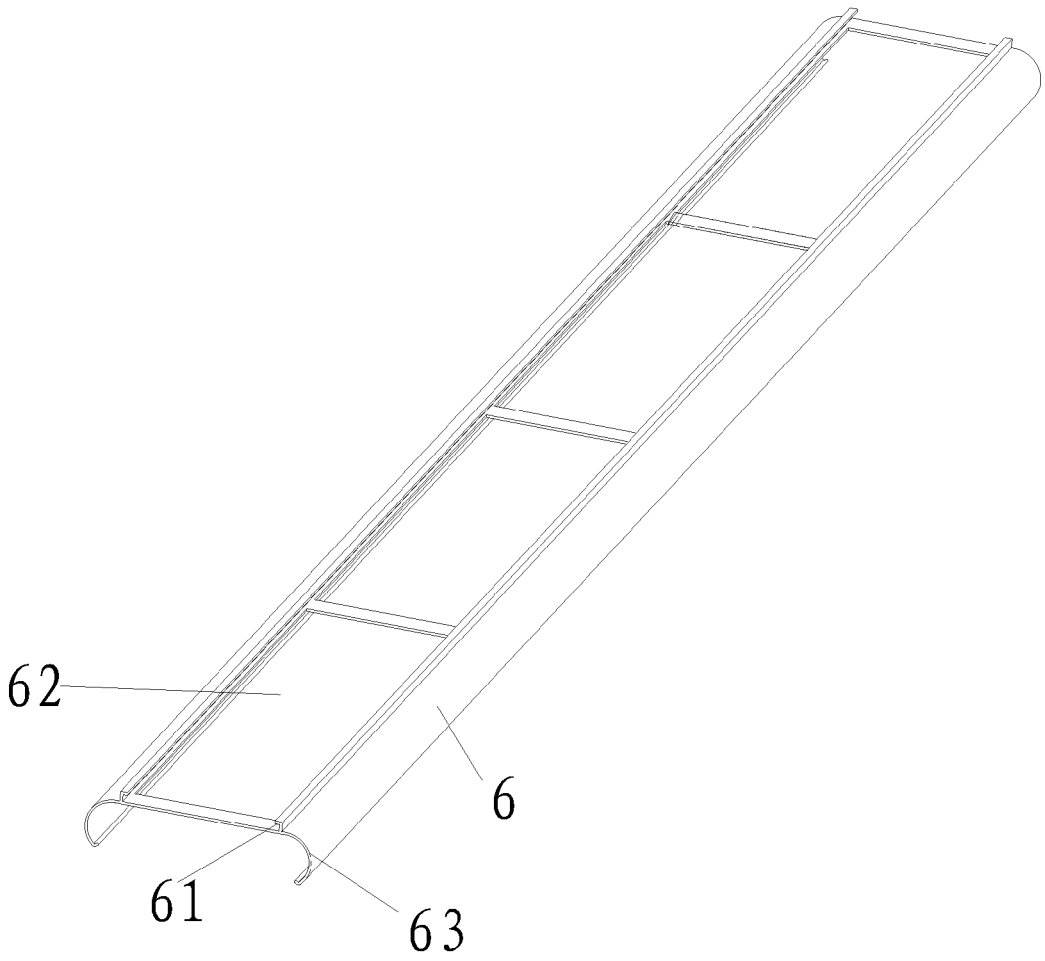
FIG. 4 is the structure diagram of the cross section of the LED fluorescent lamp of the invention.

1. base plate; 11. rolling pillar; 12. fastening groove; 13. first sliding groove; 14. second sliding groove; 2. end cap; 21. notch;
3. aluminum profile; 31. first slot; 32. second slot; 34. oil groove; 35. convex pillar.
4. light diffusing plate; 41. stripe;
5. light guide plate component; 51. first light guide plate; 53. second light guide plate; 53. circular guide pillar; 511. light reflecting layer; 512. wavy surface;
6. light shade; 61. holding groove; 62. hollowed-out part; 63. arc;
7. power unit; 71. power supply; 72. circuit board;
8. light panel component; 81. first light panel; 82. second light panel;
9. fixture; 91. telescopic component; 92. sliding pillar;
10. light tray;
111. first ratchet wheel; 112. second ratchet wheel; 113. positioning screw; 114. spring; 115. connecting component; 116. partition plate; 117. magnet component; 118. through hole; 119. limiting block.

DETAILED DESCRIPTION OF THE INVENTION

For a detailed description of the technical content, structural features, purpose, and effect of the invention, the following implementation mode and the drawings are utilized.

The key conception of the invention is as follows: the first lamp panel and the second lamp panel are arranged on the aluminum profile in an oblique manner, so that the light-emitting angle of the whole LED fluorescent lamp is more than 180 degrees; the lamp shade is provided with many crossed stripes, which are used for forming diamond-shaped stripes; the light emitted by the LED lamp bead is reflected or refracted by the diamond-shaped stripes, so that shining light directly into people's eyes is avoided; the upper surfaces of the light guide plates are coated with light reflecting layers capable of reflecting the incident light and increasing the illumination intensity of the LED fluorescent lamp; moreover, the light guide plates are rationally fixed on the aluminum profile to adjust the light-emitting angle of the LED lamp bead; the lower surfaces of the light guide plates are provided with wavy surfaces for increasing thermal radiation area.

Referring to FIG. 1-6, an LED fluorescent lamp comprises a base plate 1, an end cap 2, an aluminum profile 3, a light diffusing plate 4, a light guide plate component 5, a lamp shade 6, a power unit 7 and a lamp panel component 8, as well as an LED lamp bead arranged on the lamp panel component 8; the cross section of the aluminum profile 3 is n-shaped; the lamp shade 6 is installed on the top of the aluminum profile 3 to form an enclosed space; the base plate 1 is arranged at the bottom of the aluminum profile 3 and is enclosed with the aluminum profile 3 to form a holding cavity; the power unit 7 is located in the holding cavity; the end cap 2 covers the base plate 1, the aluminum profile 3, and the end of the base plate 1.

The first slots 31 are arranged on the two left side walls of the aluminum profile 3; the light guide plate component 5 comprises two light guide plates, including the first light guide plate 51 and the second light guide plate 52; the first light guide plate 51 and the second light guide plate 52 are respectively provided with circular guide pillars 53 at one side; the first light guide plate 51 and the second light guide plate 52 are rotationally clamped in the first slots 31; the upper surfaces of the first light guide plate 51 and the second light guide plate 52 are flat and are provided with light reflecting layers 511; and the lower surfaces of the first light guide plate 51 and the second light guide plate 52 are wavy surfaces 512.

The top of the lamp shade 6 is provided with a holding groove 61; the bottom of the holding groove 61 is hollowed out with a hollowed-out part 62; the light diffusing plate 4 is fixed in the holding groove 61 and the surface of the light diffusing plate 4 is provided with a plurality of stripes 41, which are crossed to form diamond-shaped stripes; and two sides of the lamp shade are circular arcs 63.

Known from the above description, the beneficial effects of the invention are as follows: the invention provides an LED fluorescent lamp; a first lamp panel 81 and a second lamp panel 82 are arranged on the aluminum profile 3 in an oblique manner; the first lamp panel 81 and the second lamp panel 82 can make the light-emitting angle of the whole LED fluorescent lamp more than 180 degrees; the lamp shade 6 is provided with a light diffusing plate 4, on which many crossed stripes 41 are arranged to form diamond-shaped stripes; the light emitted by the LED lamp bead is reflected or refracted by the diamond-shaped stripes, so that shining light directly into people's eyes is avoided; meanwhile, the left side and the right side of the aluminum profile 3 are provided with light guide plates; the upper surfaces of the light guide plates are coated with light reflecting layers 511 capable of reflecting the incident light and increasing the illumination intensity of the LED fluorescent lamp; moreover, the light guide plates are rationally fixed on the aluminum profile 3 to adjust the light-emitting angle of the LED lamp bead; the lower surfaces of the light guide plates are provided with wavy surfaces 512 for increasing the thermal radiation area; and the light guide plates combine with the aluminum profile 3 to obtain a better thermal radiation effect.

Figure 10:
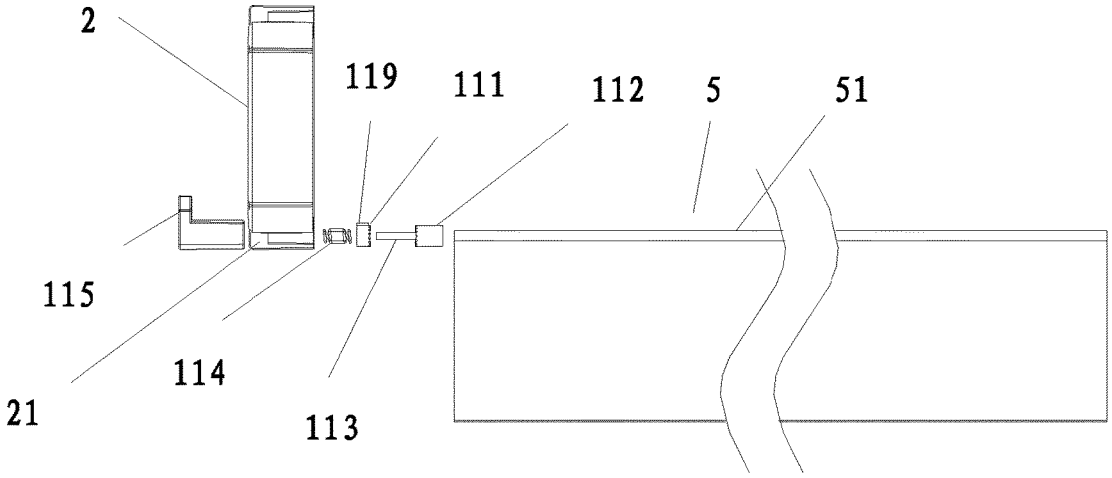
FIG. 10 is the assembling diagram of FIG. 9.
Figure 11:
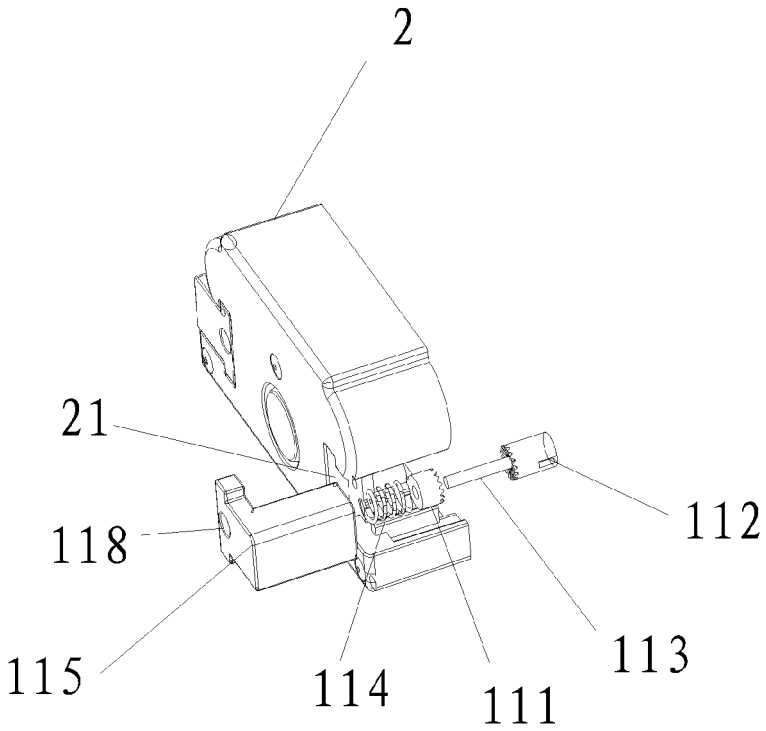
FIG. 11 is the structure diagram of the LED fluorescent lamp of the invention with the lamp tray.

In one embodiment, referring to FIG. 10 and FIG. 11, the LED fluorescent lamp further comprises a rotary adjusting component. The rotary adjusting component comprises a connecting component 115, a spring 114, a first ratchet wheel 111, a second ratchet wheel 112, and a positioning screw 113; the end cap 2 is provided with a notch 21; the connecting component 115 is located in the notch 21 and is internally provided with a groove position; the spring 114, the first ratchet wheel 111 and the second ratchet wheel 112 are located in the groove position; one end of the spring 114 is arranged against the bottom of the groove position and the other end is arranged against the first ratchet wheel 111; the first ratchet wheel 111 and the second ratchet wheel 112 are engaged; the side wall of the first ratchet wheel 111 is provided with a limiting block 119; the side wall of the connecting component 115 is provided with a through hole 118; the positioning screw 113 passes through the through hole 118, the spring 114, and the first ratchet wheel 111 in sequence and then is fixed with the second ratchet wheel 112; the second ratchet wheel 112 is fixed with the end of the circular guide pillar 53. In rotation, unscrew the fixing screw, and the first ratchet wheel separates from the second ratchet wheel through the restoring force of the spring; after the light guide plate component is fixed, screw up the fixing screw, the spring is compressed to enable the first ratchet wheel to be engaged with the second ratchet wheel, and the light guide plates are limited and fixed through the limiting block on the first ratchet wheel.

Figure 5:
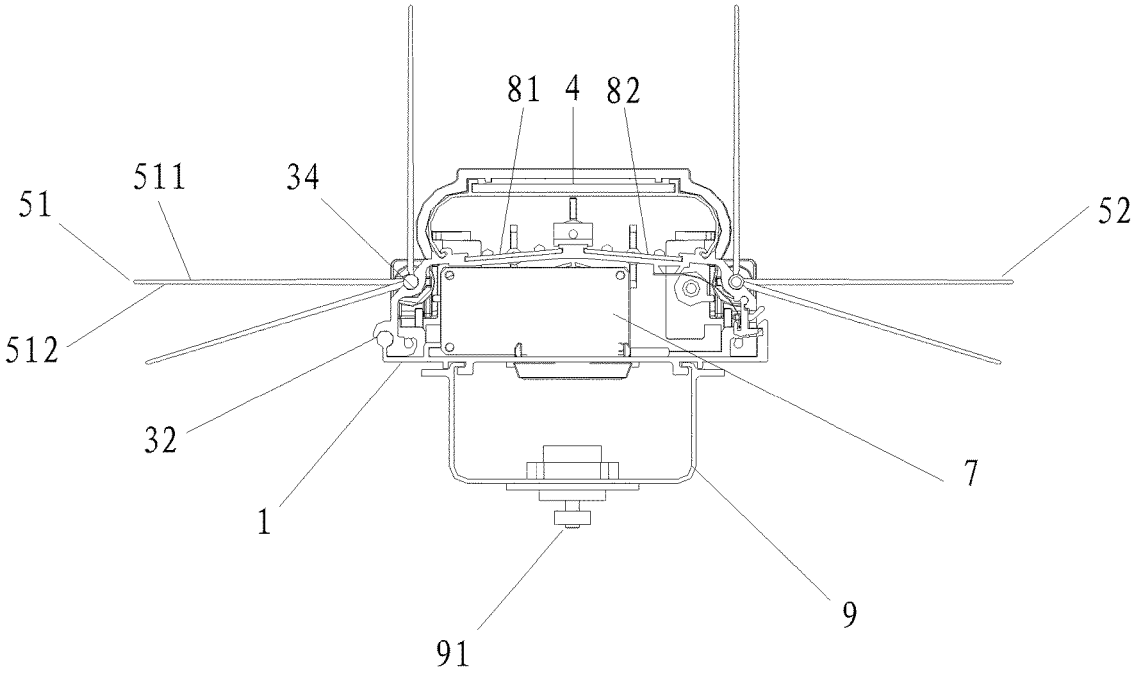
FIG. 5 is the breakdown diagram of the cross section of the LED fluorescent lamp of the invention.
Figure 6:
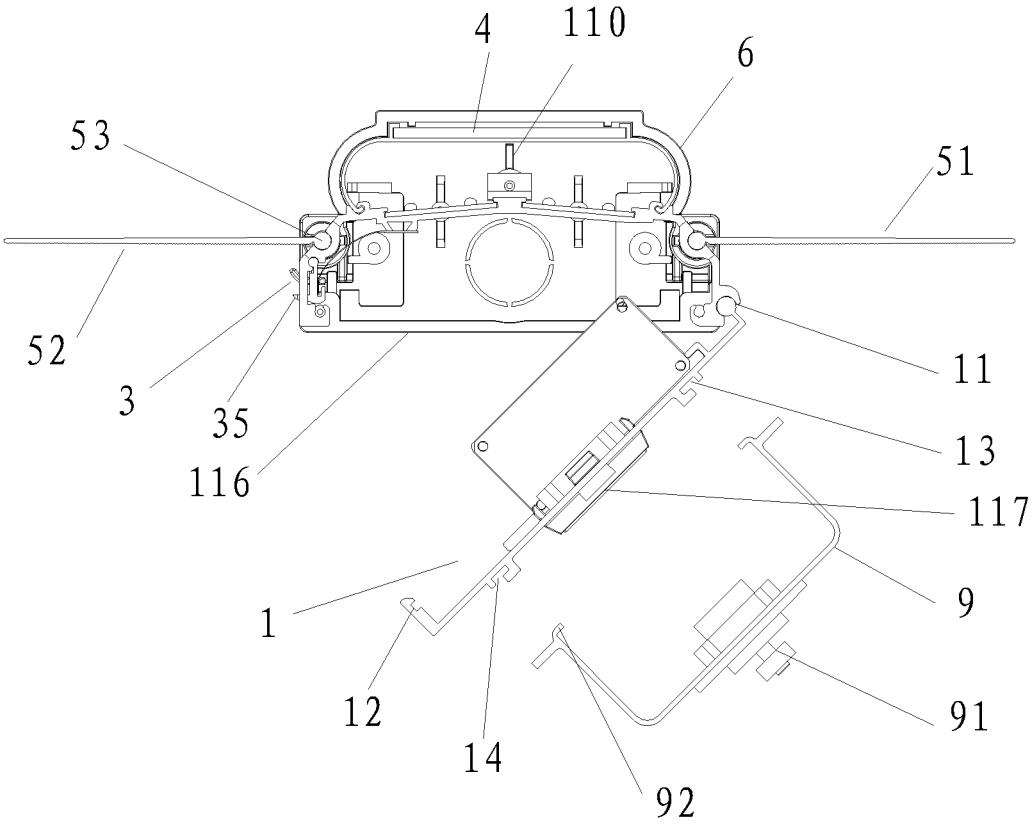
FIG. 6 is the combined structure diagram of the light guide plate and the aluminum profile of the invention.
Figure 7:
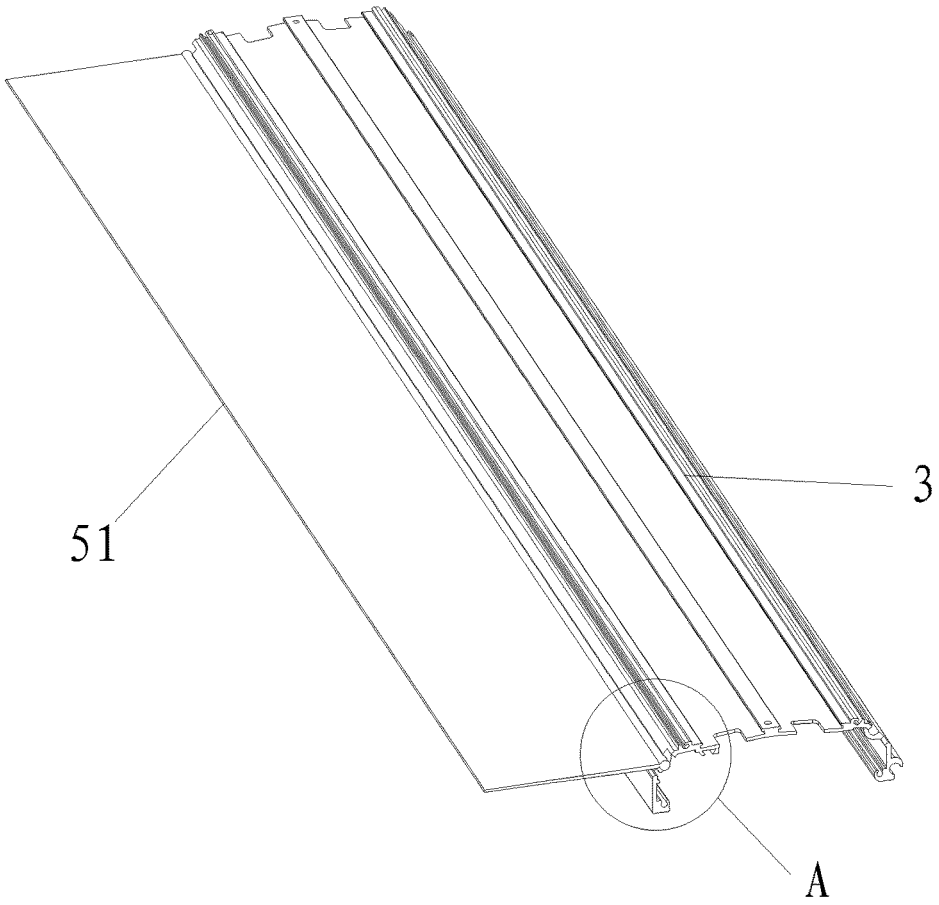
FIG. 7 is the diagram of the embodiment of the LED fluorescent lamp of the invention.
Figure 8:
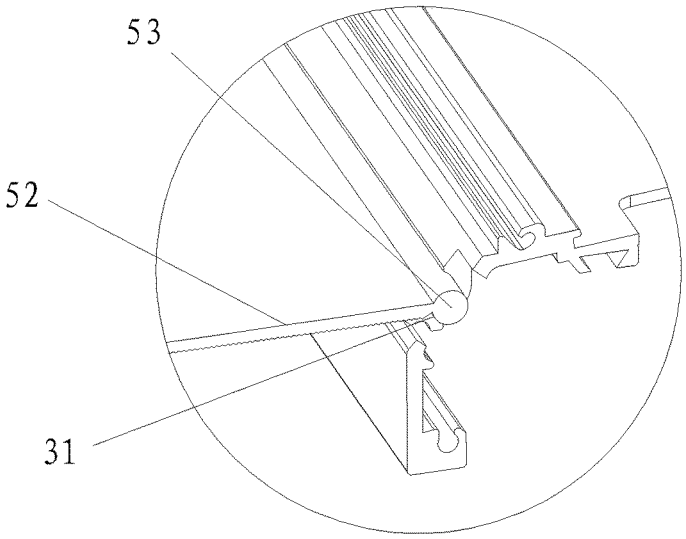
FIG. 8 is the amplified diagram of the part A in FIG. 7.
Figure 9:
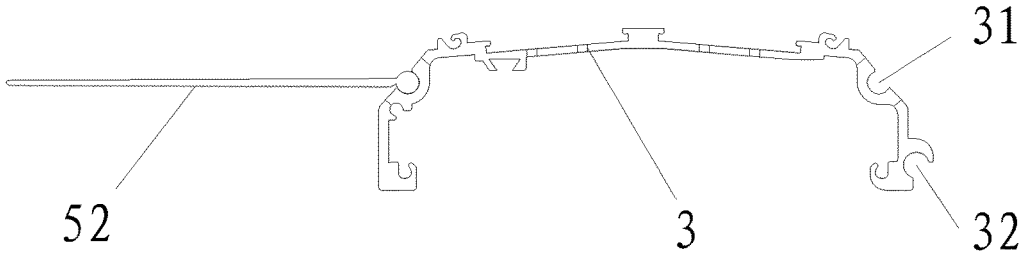
FIG. 9 is the breakdown structure diagram of the rotary adjusting component of the invention.

In one embodiment, referring to FIG. 5 and FIG. 6, the internal side wall of the first slot 31 is provided with a plurality of oil grooves 34; the oil grooves 34 are parallel with each other and extend along the lengthwise direction of the first slot 31. The quantity of the oil grooves are designed according to the specific requirements; the oil grooves are filled with heat conducting medium, so that the heat conducting efficiency between the aluminum profile and the light guide plate is further improved.

In one embodiment, referring to FIG. 4-7, the lamp panel component comprises a first lamp panel 81 and a second lamp panel 82; the first lamp panel 81 and the second lamp panel 82 are located on the top of the aluminum profile 3; the first lamp panel 81 is arranged from the top centre line of the aluminum profile 3 to the left side wall of the aluminum profile 3; the second lamp panel 82 is inclined from the top centre line of the aluminum profile 3 to the right side wall of the aluminum profile 3. The structure can increase the scope of the light-emitting angle. Except for the above structure, the scheme can be expanded to be a scheme with three lamp panels; one lamp panel is arranged at the middle position and two lamp panels are arranged at two sides of the middle lamp panel, so that the light-emitting angle of the whole fluorescent lamp can be increased.

In one embodiment, referring to FIG. 5-9, one side wall of the aluminum profile 3 is further provided with a second slot 32 and the other side wall is provided with a convex pillar 35; one side of the base plate 1 is provided with a rolling pillar 11 in a rotary connection with the second slot 32, and the other side is provided with a fastening groove 12 fastened with the convex pillar 35. In installation, the rolling pillar stretches into the second slot and then the other side of the rotary base plate is fastened on the convex pillar to realize convenient installation and maintenance.

In one embodiment, referring to FIG. 5 and FIG. 6, the LED fluorescent lamp further comprises a fixture 9; the lower surface of the base plate 1 is provided with sliding grooves along the length direction; the sliding grooves are divided into a first sliding groove 13 and a second sliding groove 14, which are symmetric to each other; two sides of the fixture 9 are correspondingly provided with sliding pillars 92; and the sliding pillars 92 can reciprocate along the length direction of the sliding grooves. Through the above structure, the position of the LED fluorescent lamp can be adjusted along the lengthwise direction of the fixture.

In one embodiment, referring to FIG. 6, the bottom of the fixture 9 is provided with a telescopic component 91. The telescopic component can adjust the vertical distance between the base plate and the ceiling.

In one embodiment, referring to FIG. 6, a partition plate 116 is arranged between the aluminum profile 3 and the base plate 1; the lower surface of the partition plate 116 is provided with a magnet component 117, which is magnetically fixed with the base plate 1. Because of the magnetic attraction of the magnetic component and the base plate, the installation is convenient.

Figure 12:
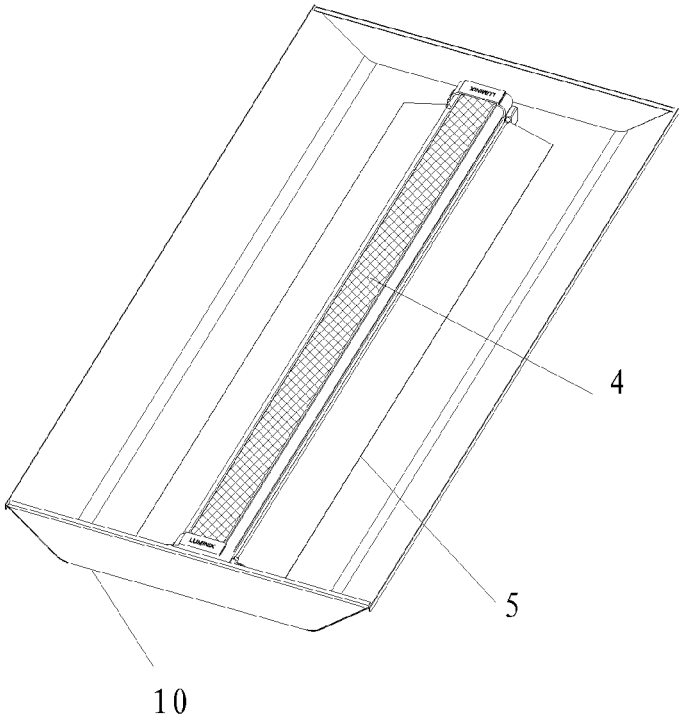
FIG. 12 is the internal structure diagram of the LED fluorescent lamp of the invention.

In one embodiment, referring to FIG. 12, the LED fluorescent lamp further comprises a lamp tray 10 with an inverted trapezoidal cross section; the base plate 1 is fixed at the bottom of the lamp tray 10, and the aluminum profile 3 and the lamp shade 6 are located in the lamp tray.

Figure 13:
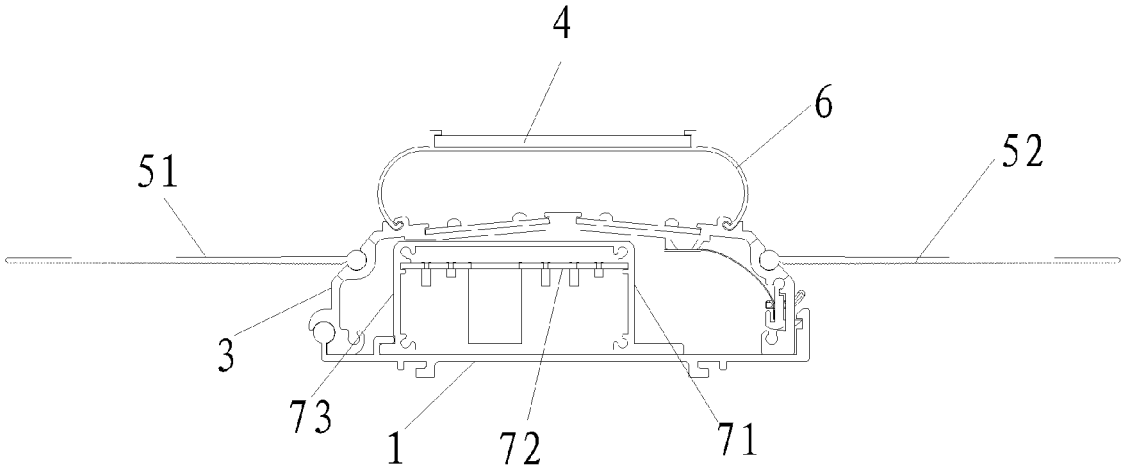
FIG. 13 is the structure diagram of the lamp shade of the LED fluorescent lamp of the invention.
Figure 14:
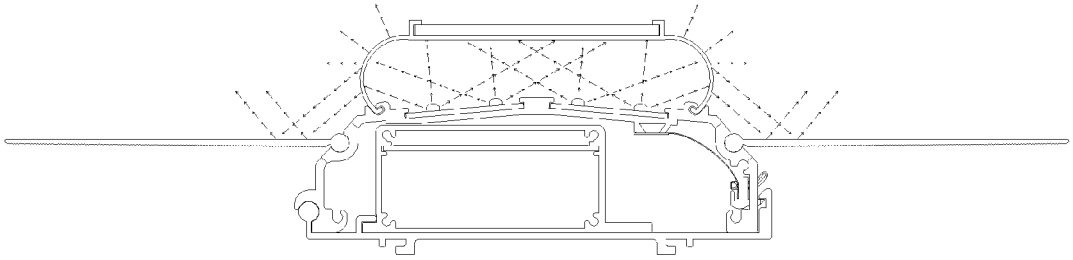
FIG. 14 is the light path diagram of the LED fluorescent lamp of the invention.
Figure 15:
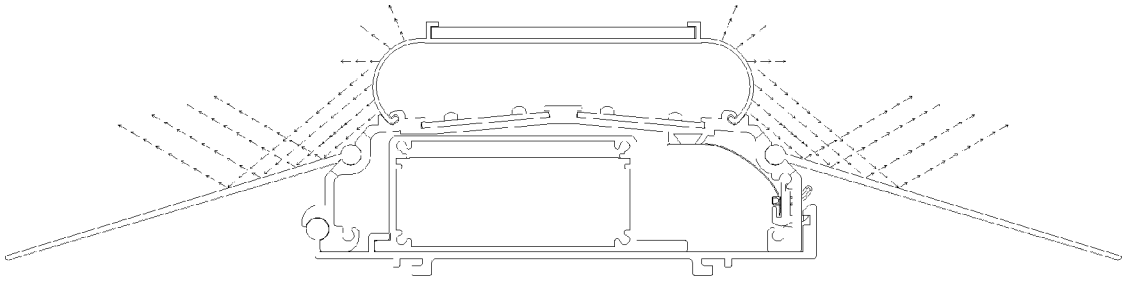
FIG. 15 is the light path diagram of the other embodiment of the LED fluorescent lamp of the invention.

In one embodiment, referring to FIG. 13-15, the power unit comprises a power supply 71, a circuit board 72, and a mounting base 73; the circuit board 72 is inverted in the mounting base 73 and the welding surface of the circuit board 72 faces at the base plate 1; the power supply 71 is arranged at one side of the mounting base 73. The circuit board is inverted to facilitate thermal radiation.

Seen from FIG. 14 and FIG. 15, the light-emitting angle of the LED fluorescent lamp in the scheme is more than 180 degrees; the light emitted by the LED lamp bead has good uniformity and no dark space. Along with different angles of the light guide plates, the light emitting scope of the whole lamp panel is different and an adjustable light-emitting angle is realized.

In addition, in the other preferable scheme, the distance between the LED lamp bead and the top wall, as well as the side wall of the lamp shade, is 15-30 mm; and the distance makes the LED fluorescent lamp have the best light efficiency.

In conclusion, the LED fluorescent lamp provided by the invention can increase thermal radiation area and obtain better thermal radiation effect through the wavy surfaces of the light guide plates, the aluminum profile, the oil groove on the aluminum profile and the radiating fins; the light reflecting layer coated on the surface of the light guide plate component is capable of reflecting the incident light, so that good illumination intensity is realized; the light guide plate component is rotationally clamped on the aluminum profile so as to facilitate the adjustment of the light-emitting angle of the LED fluorescent lamp; the lamp shade is provided with a light diffusing plate, on which diamond-shaped stripes are arranged to reflect or refract the incident light; therefore, shining light directly into the eyes is avoided and the soft light is beneficial to protect eyes; the base plate is rotationally connected with one side of the aluminum profile and the other side is fastened and fixed, so that the convenient installation is realized; the lower part of the base plate is provided with the fixture; the base plate can reciprocate on the fixture, so that the position of the base plate can be adjusted easily. In addition, the whole LED fluorescent lamp is light in weight and convenient to assemble.

The above description is only used as the embodiments of the invention, but not restricting the patent scope of the invention. All transformations of equivalent structures or equivalent processes in the use of the description of the invention as well as the drawings, or direct/indirect application in the other related technical fields are included in the patent protection scope of the invention.

The invention claimed is:

1. An LED fluorescent lamp comprises a base plate, an end cap, an aluminum profile, a light diffusing plate, a light guide plate component, a light shade, a power unit and a lamp panel component, as well as an LED lamp bead on the lamp panel component; the cross section of the aluminum profile is wave-shaped; the lamp shade is installed on the top of the aluminum profile to form an enclosed space; the base plate is located at the bottom of the aluminum profile and enclosed with the aluminum profile to form a holding cavity; the power unit is located in the holding cavity; the end cap covers the base plate, the aluminum profile and the end of the base plate; first slots are arranged on two left side walls of the aluminum profile; the light guide plate component comprises two light guide plates, which are provided with circular guide pillars at one side and rotationally sleeved in the first slots; upper surfaces of the light guide plates are flat and are provided with light reflecting layers; and lower surfaces of the light guide plates are wavy surfaces; the top of the lamp shade is provided with a holding groove, at the bottom of the holding groove a hollowed-out part is hollowed out; the light diffusing plate is fixed in the holding groove and provided with the plurality of stripes on the surface; the stripes are crossed to form diamond-shaped stripes; and two sides of the light shade are arcs.

2. The LED fluorescent lamp according to claim 1, wherein it further comprises a rotary adjusting component, comprising a connecting component, a spring, a first ratchet wheel, a second ratchet wheel and a positioning screw; the end cap is provided with a notch; the connecting component is located at the notch and is internally provided with a groove position; the spring, the first ratchet wheel, and the second ratchet wheel are located in the groove position; one end of the spring is arranged against the bottom of the groove position and the other end is arranged against the first ratchet wheel; the first ratchet wheel and the second ratchet wheel are engaged; the side wall of the first ratchet wheel is provided with a limiting block; the side wall of the connecting component is provided with a through hole; the positioning screw passes through the through hole, the spring and the first ratchet wheel in sequence; and then the positioning screw is fixed with the second ratchet wheel; and the second ratchet wheel is fixed with the end of the circular guide pillar.

3. The LED fluorescent lamp according to claim 1, wherein the light panel component comprises a first lamp panel and a second lamp panel; the first lamp panel and the second lamp panel are located at the top of the aluminum profile; the first lamp panel is arranged from the top centre line of the aluminum profile to the left side wall of the aluminum profile; and the second lamp panel is inclined from the top centre line of the aluminum profile to the right side wall of the aluminum profile.

4. The LED fluorescent lamp according to claim 1, wherein the external side walls of the arcs are provided with frosted surfaces.

5. The LED fluorescent lamp according to claim 4, wherein one side wall of the aluminum profile is provided with a second slot and the other side wall is provided with a convex pillar; one side of the base plate is provided with a rolling pillar in a rotary connection with the second slot and the other side is provided with a fastening groove which is fastened with the convex pillar.

6. The LED fluorescent lamp according to claim 5, wherein it comprises a fixture; the lower surface of the base plate is provided with sliding grooves along the length direction; the number of the sliding grooves is two; two sides of the fixture are correspondingly provided with sliding pillars capable of reciprocating along the length direction of the sliding grooves.

7. The LED fluorescent lamp according to claim 6, wherein the bottom of the fixture is provided with a telescopic component.

8. The LED fluorescent lamp according to claim 6, wherein a partition plate is arranged between the aluminum profile and the base plate; and the lower surface of the partition plate is provided with a magnet component, wherein the magnetic component is magnetically fixed with the base plate.

9. The LED fluorescent lamp according to claim 1, wherein the LED fluorescent lamp further comprises a lamp tray with an inverted trapezoidal cross section; the base plate is fixed at the bottom of the lamp tray, and the aluminum profile and the lamp shade are located in the lamp tray.

10. The LED fluorescent lamp according to claim 1, wherein the power unit comprises a power supply, a mounting base, and a circuit board; the circuit board is inverted in the mounting base and the welding surface of the circuit board faces the base plate; and the power supply is arranged at one side of the mounting base.

* * * * *